US007131169B2

(12) United States Patent
Folkmar

(10) Patent No.: US 7,131,169 B2
(45) Date of Patent: Nov. 7, 2006

(54) HINGED CLIP WITH SEPARABLE JAWS

(76) Inventor: Jan Folkmar, Arnika, CH-7050 Arosa (CH)

( * ) Notice: Subject to any disclaimer, the term of this patent is extended or adjusted under 35 U.S.C. 154(b) by 0 days.

(21) Appl. No.: 09/813,476

(22) Filed: Mar. 22, 2001

(65) Prior Publication Data

US 2002/0133916 A1 Sep. 26, 2002

(51) Int. Cl.
*B65D 77/10* (2006.01)

(52) U.S. Cl. ..... 24/30.5 R; 24/518

(58) Field of Classification Search ..... 24/517, 24/505, 518, 506, 519, 520, 543, 489, 30.5 R, 24/30.5 P; 383/68; 606/120, 151, 157, 158
See application file for complete search history.

(56) References Cited

U.S. PATENT DOCUMENTS 3,040,749 A * 6/1962 Payton
4,487,205 A * 12/1984 Di Giovanni et al.
5,050,272 A * 9/1991 Robinson et al.
5,054,168 A * 10/1991 Gandy et al.
5,079,806 A * 1/1992 Allen
5,713,108 A * 2/1998 Solomon et al.
5,738,444 A * 4/1998 Lantz et al.
5,846,255 A * 12/1998 Casey
6,105,217 A * 8/2000 Caradine et al.

FOREIGN PATENT DOCUMENTS

JP 8-48345 * 2/1996

* cited by examiner

*Primary Examiner*—James R. Brittain

(57) ABSTRACT

A molded clip for closing bags and the like includes a pair of claws with a latch and a hinge at opposed ends. The hinge extends rearwardly from the jaws and includes a hinge bearing with a rearwardly facing opening of restricted diameter thereto. The other jaw includes a fixed hinge pin which may be snap engaged into the bearing by resilient passage through the opening. Where the jaws are relatively large, they may be provided with cooperating shoulders that restrict axial movement of the jaws under reactively generated forces. In accordance with one embodiment, one of the jaws is double sided, and the clip may be assembled with either of these sides confronting the other jaw to provide different clip functions.

15 Claims, 4 Drawing Sheets

HINGED CLIP WITH SEPARABLE JAWS

FIELD OF INVENTION

This invention relates to clips which have a use for closing bags, although they are not necessarily limited to such use.

BACKGROUND OF THE INVENTION

Clips of the foregoing nature are well known in commerce, and may be generally exemplified by the clips described in U.S. Pat. Nos. 4,887,335, and 6,058,572, of common inventorship herewith. The clips in general comprise a pair of axially extending jaws which are interconnected at one end by a hinge so as to be swingable between an open position and a closed position, in which confronting portions of the jaws are in proximity, and a latch at the axially opposed end for releasably retaining the jaws closed. For economy of manufacture the hinge is typically a live hinge (also known as a living hinge). However, such form of hinge is not always suitable, for example where it is desired to form the clip from a material with a relatively high modulus of elasticity. Also, it is not always convenient or desired that the clip be molded as a unitary structure.

It is known to form clips which are generally of the foregoing type, but in which the jaws are connected through a hinge pin. In early examples of such clips, the hinge pin was inserted through interleaved gudgeon openings associated with the jaws, in a machine operation. In U.S. Pat. No. 5,050,272 there is described a clip wherein the jaws may be snap assembled together in a hand operation. In this clip one of the jaws is channeled, and the opposing jaw comprised a rib which interleaves in the channel when the jaws are closed. The hinge pin is integrally molded with the channeled jaws to span between opposed side walls thereof, and the rib is provided with a downwardly open slot within which the pin is engagable. The geometry of the arrangement is such that it reduces the size of a bag that can be closed by the clip in comparison to a similar sized clip with a living hinge. Additionally, the axial end of the channeled jaw is open at the hinge pin end, to permit the pin to be molded integrally with the jaw. Accordingly, the channeled jaw may be highly stressed when the clip is in use, leading to a possible failure of the clip. Still further, if the jaws of the clip are fully opened, the one jaw will act as a fulcrum, and the slot of the ribbed jaw will disengage from the hinge pin. Moreover, while it is not uncommon that one at least of the jaws of a clip be formed with the requisite channel structure, this is not necessarily the case.

In all clips of the foregoing nature, reactive forces are generated as the jaws of the clip are closed about a bag or the like. Where the clip is intended for use for closing heavy bags or sacks, which may have a contents in the range of about 25 to 50 kg, the jaws may typically have a length of some 250 mm, and strong reactive forces may be generated sufficient to displace the jaws in the axial direction. This may result in the failure of the latch elements to engage together, and where the hinge is of a snap together type, in the disengagement of the hinge elements.

Many comestible and other products are sealed in bags or the like for sale to the consumer; the bags must be opened, usually with a knife or scissors, to gain access to the contents, following which the bags may be closed by the clips to which the invention relates. It would be desirable to provide in a clip one or more accessory functions, for example a slitter to slice open a bag, or a measuring scoop or cup to facilitate the removal of a measured amount of product from the bag, or a handle to facilitate the handling of the bag, particularly where this may be heavy.

It is a prime object of the invention to provide a clip with a snap together hinge which has a closure capacity at least equal to that of a comparable clip with a living hinge.

It is another object of this invention to provide a clip with a snap together hinge which will resist the tendency for disengagement if over-rotated.

It is still another object of the invention to provide a clip with a snap together hinge which will resist the tendency of the jaws to be axially displaced under heavy loads.

It is yet another aspect of the invention to provide in a clip a snap together hinge which is relatively independent of the jaw structure.

It is a further object of this invention to provide a clip having different modes of operation.

It is a still further object of this invention to provide a clip having one or more accessory functions.

DESCRIPTION OF THE INVENTION

In accordance with one aspect of the invention, a molded clip of the type comprising an upper jaw and a lower jaw generally coextensive therewith, each of which jaws has axially opposed ends, with hinge means disposed at one of the axial ends to permit the jaws to rotate between an open position and a closed position in which the jaws are in mutually confronting relationship, and latch means disposed at the axial end opposed to the hinge means for releasably retaining the jaws in their closed position is characterized wherein said hinge means comprises a hinge bearing disposed at the rearward end of the jaws, the hinge bearing comprising a pair of laterally spaced apart, rearwardly extending lower bearing portions to define a passage therebetween, and at least one rearwardly extending upper bearing portion disposed in superior, spaced apart relation to the lower portions. Mutually confronting surfaces of the bearing portions together define a transversely extending gudgeon opening and a rearwardly open throat of restricted diameter in comparison to that of the gudgeon opening, the throat opening communicating with both the passage and the gudgeon opening. The hinge means further comprises a tab extending rearwardly from the rearward end of the lower of the jaws and a hinge element receivable in the gudgeon opening for rotation therein, the hinge element and the throat opening being dimensioned to permit the passage of the hinge element therealong under the influence of a biasing force which may suitably be manually applied.

The disposition of the hinge structure rearwardly of the mutually confronting jaw surfaces permits a clip to be formed with separately formed jaws which has a closure capacity which is generally not less than that of a comparably sized clip having a living hinge. It also permits a hinge geometry which is relatively independent of the jaw structure.

In accordance with another aspect of the invention, the lower ones of the hinge bearing portions extend rearwardly beyond the throat opening, so as to form an abutment to prevent the over rotation of the jaws. As the lower of the jaws swings into contact with the abutment, any further attempt to force the jaws open will tend to close the throat opening, and securely trap the hinge pin within the gudgeon opening. The distal ends of these rearwardly projecting portions may suitably be interconnected by a bight, to provide a convenient means for suspending the clip in a point of sale display, for example, or for suspending a bag that is closed by the clip.

Where the upper jaw of the clip is provided with a channel therealong within which a rib formed on the lower jaw may be interleaved, the rearward end of the channel may be closed by a rear wall to increase the strength of the jaw. Suitably, a portal may be formed in the rear wall to communicate with the passage to permit the rearwardly projecting tab to pass therethrough.

In accordance with yet another aspect of the invention, one or both of the jaws may be formed to have a different profile on opposed surfaces thereof. Accordingly, the clip may be assembled in one manner so as to provide a first function, and then reassembled by a user in a different manner to provide another function.

Clips which are generally of the foregoing nature may often be used to close bags that are marketed in a sealed condition, and which can only be opened using a knife or scissors. In accordance with still another aspect of the invention, a clip may be provided with integrally formed cutting means, which obviates the requirement for scissors or the like. Still further, the bags once opened, may be stored in other containers. Accordingly, the invention contemplates bag-closure clips wherein there is provided a resilient finger supported from one of the jaws, which finger will serve to clip the closure clip to a container when it is not in use.

These and still other aspects of the invention will be described in relation to preferred embodiments of the invention which are illustrated by the drawings annexed hereto.

It will be understood that in the foregoing description, and throughout the specification, the terms upper and lower, forward and rearward and the like are all used in a relative sense for convenience only, and that they are not limitative of the invention.

DESCRIPTION OF THE PREFERRED EMBODIMENTS

Figure 1:
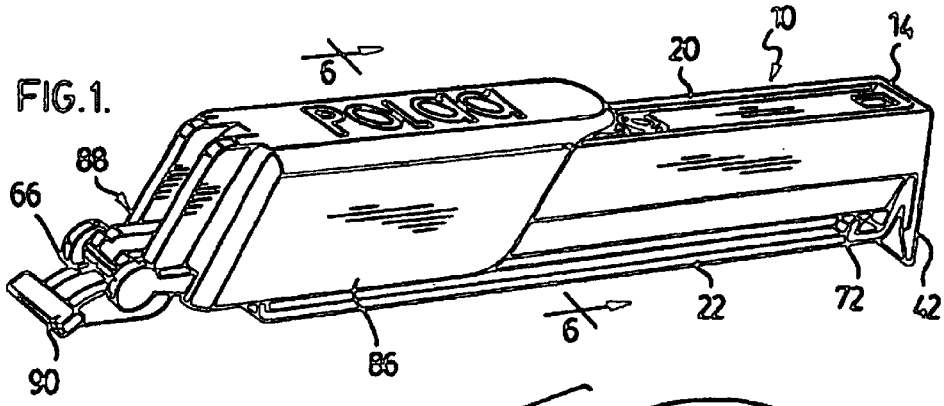
FIG. 1 shows in perspective view from the rear, top, right side of a heavy duty clip in accordance with the invention, together with an accessory scoop.

Referring to the drawings in detail, in accordance with a first embodiment of the invention illustrated in FIGS. 1–7, a heavy duty clip is identified generally therein by the numeral 10. Clip 10 has a rearward end 12 and a forward end 14, and a longitudinal axis therebetween, and in general will have an axial plane of symmetry. Clip 10 comprises an upper jaw 20 and a lower jaw 22; the upper jaw is defined in part by a top wall 24, side walls 26, and end walls 28, each of which depend from the top wall, with the end walls interconnecting the side walls, the walls together forming a downwardly open channel 30.

Lower jaw 22 comprises an axially extending flange 34 and an axially extending rib 36 upstanding from the flange. Given that clip 10 of this first embodiment is particularly intended for heavy duty use, the cross section of the flange at the juncture with rib 36 may be physically large, and in accordance with general molding practice, the mass of the cross section is reduced by forming flange 34 with a slotted depression therealong, bridged at axially spaced apart intervals by webs 38. Jaws 20, 22 are interconnected at their rearward end by hinge structure identified generally by the numeral 40, and at their forward end by releasable latch 42. As thus far described, clip 10 is of a more or less conventional structure.

In accordance with the invention, hinge 40 comprises a hinge bearing 44 mounted on the upper jaw and disposed rearwardly of the rear end wall 28 thereof, and a transversely extending hinge rod 46 supported from a tab 48 which extends rearwardly from rib 36. Hinge bearing 44 comprises a pair of laterally spaced apart projections 50 which extend rearwardly from jaw 20 generally in the planes of the left and right side walls 26 respectively, to define a passage 52 therebetween. Hinge bearing 44 further comprises a superior portion formed by a tongue 54, which projects rearwardly from rear end wall 28 in spaced apart relation to projections 50, the confronting surfaces of projections 50 and tongue 54 forming a gudgeon opening 60. The distal end 56 of tongue 54 is downwardly hooked towards projections 50 so as to form therewith a transversely extending throat opening 58 which has a restricted diameter in comparison to that of gudgeon opening 60. Throat opening 58 communicates with both the gudgeon opening 60 and passage 52. The area of the bearing surface is increased by providing small bosses 62 on the inwardly facing wall surfaces of projections 50. It will be understood that the transverse spacing between bosses 62 is similar to the transverse width of tab 48, so as to retain jaw 22 centered in relation to jaw 20 when clip 10 is opened. It may be noted that a small portal 64 is provided in end wall 28 of jaw 20, which portal communicates with passage 52 and which extends upwardly to adjacent the root of tongue 54, to permit the passage of tab 48 through end wall 28. The rearward ends of projections 50 extend rearwardly beyond the distal end 56 of tongue 54 and are interconnected by a bight 66 for purposes to be described.

In assembling jaws 20, 22 together, the lower jaw 22 is oriented so as to pass hinge rod 46 upwardly between projections 50, and then to align the hinge rod opposite throat opening 58. Lower jaw 22 is then urged forwardly, to force hinge rod 46 through throat opening 58 and to snap into gudgeon opening 60, and into contact with the bearing surfaces defined thereby.

Rib 36 and flange 38 of lower jaw 22 are dimensioned and positioned such that when clip 10 is closed, a serpentine passage 70 is created between the rib and the walls defining channel 30. A spacer boss 72 is provided on the upper surface of flange 38 to restrict the approach of the flange to the peripheral extremity of the side walls defining channel 30, the clearance partially defining the serpentine passage 70. The upper edge of rib 36 is provided with a lacuna 74 extending substantially along the axial length of the rib, the rearward end portion only of the lacuna being seen in FIG. 3, the lacuna also serving in part to define serpentine passage 70. A similar general arrangement of the jaw structure is more particularly described in the above mentioned –572 patent. The arrangement permits relatively bulky layers of bag or sack material to be clamped between jaws 20, 22. Where, as herein, clip 10 is intended for heavy duty use, the closure of jaws 20, 22 about a relatively heavy material, particularly where it may have a slick surface finish, will tend to generate a strong reactive force tending to urge upper jaw 20 forwardly relative to lower jaw 22. Where this reactive force is sufficiently great to force hinge rod 46 rearwardly through throat opening 58, the hinge assembly will disengage. The reactive force is constrained in clip 10 by providing cooperating transverse shoulder elements on jaws 20, 22. Preferably, such shoulder elements will be disposed adjacent the hinge end of clip 10, and will interact when the jaws subtend an angle of at least about 450 to each other. In clip 10, the shoulder elements are provided in lower jaw by upturned flange portions 76, and the cooperating elements in the upper jaw are provided by inverted V-shaped cutouts 78 which open onto the lower edge of each side wall 26.

Figure 2:
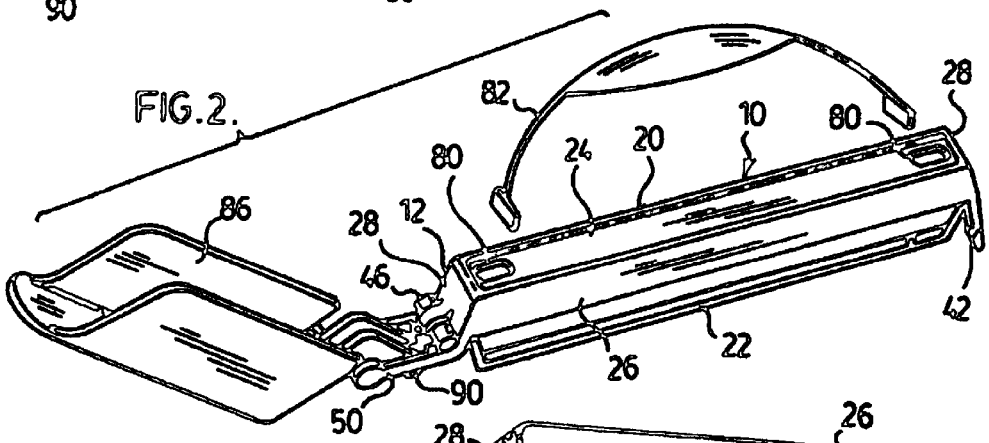
FIG. 2 is similar to FIG. 1 but shows the clip foreshortened, with the accessory scoop in its open position, and also a handle positioned for engagement with the clip.
Figure 3:
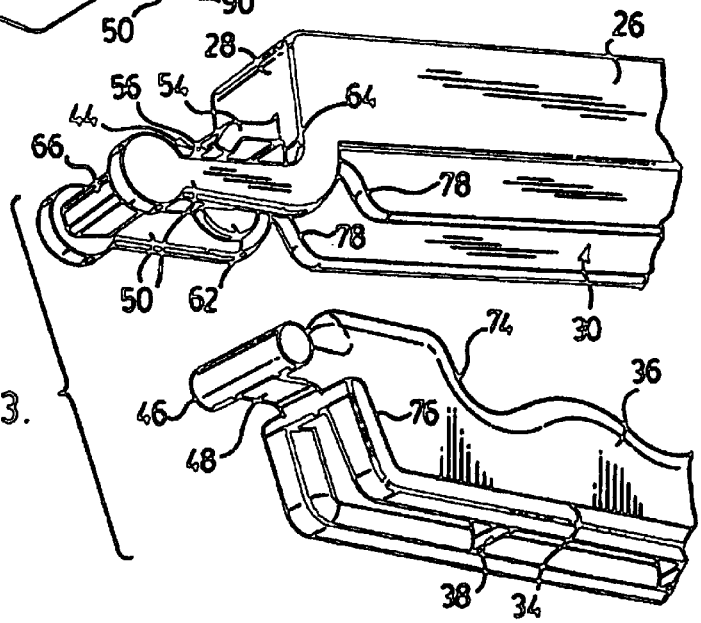
FIG. 3 shows in perspective view from the rear bottom, right side, rearward portions of the clip jaws, shown separated for clarity.
Figure 4:
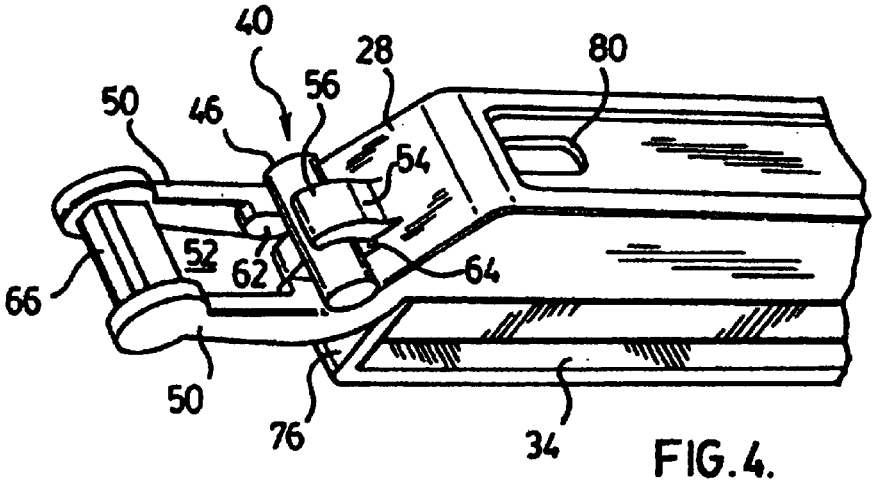
FIG. 4 shows in perspective view from the rear, top, right side, rearward portions of the clip with the jaws assembled and closed together.
Figure 5:
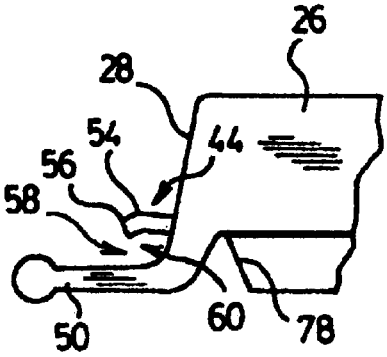
FIG. 5 shows a rearward portion of the top jaw in side elevation.
Figure 6:
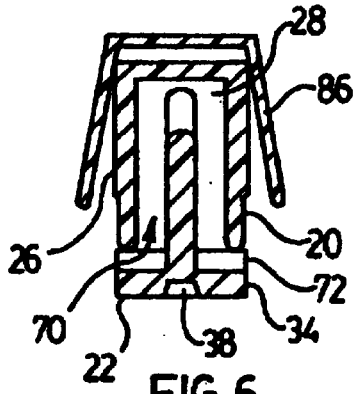
FIG. 6 shows a transverse cross section of the clip on line 6—6 of FIG. 1.

Top wall 24 is provided with a pair of axially spaced apart slotted openings 80 therein is adjacent ends 12, 14 of clip 10. A flexible handle 82 may be detachably secured in openings 80 to arch therebetween, to facilitate the use of clip 10 in carrying or suspending a heavy bag. An accessory scoop 86 may be mounted from clip 10 so as to be available for use in handling the contents of a sack closed by the clip. Suitably, scoop 86 is provided with a hinge bearing 88 similar in nature to hinge bearing 44, and bight 66 will form a hinge rod which is grasped by hinge bearing 88, to permit the scoop to rotate. Hinge bearing 88 includes a bight 90 which has a transverse dimension such as to bear on the lower surface of projections 50 when scoop 86 is moved to its fully opened position, as seen in FIG. 2. Suitably, bight 66 is obround in cross section, and hinge bearing 88 will interact with the bight, tending to bias scoop 86 to either the open or closed position. Bight 66 will serve as a convenient point of attachment for other alternate accessories that may be used with clip 10, or it might alternately or additionally serve as a hanger for suspending clip 10 in a point of sale display, or for suspending the clip together with a bag to which the clip is attached.

Figure 7:
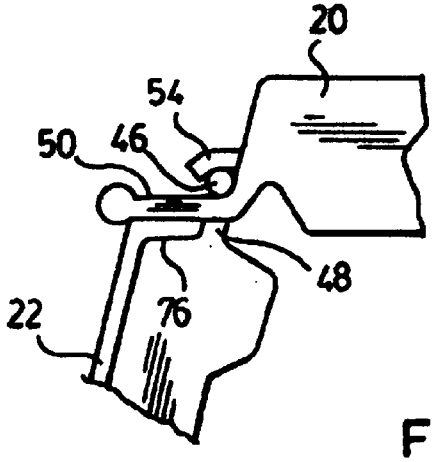
FIG. 7 shows in side elevation a rear portion of the clip when fully opened.

As best seen in FIG. 7, when the jaws of clip 10 are rotated into a fully opened position, lower jaw 22 moves into abutment with the rearward extension portions 50 of hinge 40. Further attempted rotation of jaw 22 towards the open position will then serve to urge the rearward extension portions 50 towards tongue 54 and more firmly trap hinge pin 46, thereby preventing the unintended disengagement of the jaws.

Figure 8:
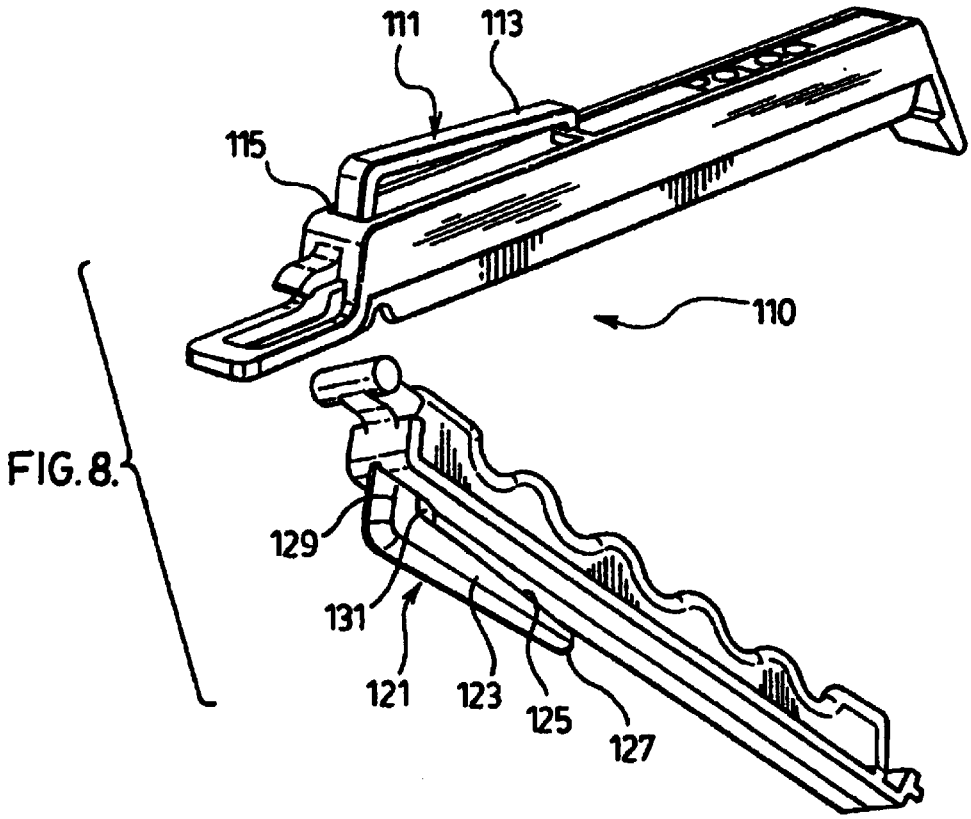
FIG. 8 shows a clip in accordance with a second embodiment in perspective, exploded view from the rear, right side.

Referring now to FIG. 8, a clip 110 therein is similarly structured to clip 10, but includes accessory appendages to facilitate the use of the clip. One such appendage comprises a hook 111 which projects upwardly from the upper wall surface of the upper jaw. Hook 111 comprises an axially extending spring finger 113 rooted at its proximal end 115 to the upper jaw of clip 110 adjacent one axial and thereof to generally overlay the upper surface of the jaw in spaced apart relationship. Hook 111 serves to attach clip 110 to an article such as a plastic milk jug or the like which is to be used to store a bag to be closed by the clip.

Clip 110 includes a further accessory appendage in the form of a cutting tool 121. Cutting tool 121 comprises a finger 123 which is relatively rigidly mounted to the lower jaw of the clip, adjacent one axial end thereof. Finger 123 extends in the axial direction of clip 110 in spaced apart relationship to the clip jaw, to define therewith an axially elongated slot 125. The width of finger 123 is progressively increased from its distal end 127 towards it proximal end 129, this having the effect of progressively diminishing the width of slot 123. A knife blade 131 is disposed in slot 125 adjacent proximal end 129 of finger 123, the plane of the blade being mounted in the axial direction of clip 110, while the cutting edge of the blade is downwardly rearwardly inclined. Typically, cutting tool 121 will be used to slice open a sealed container, which may for example be a milk bag or carton, which may then be closed by clip 110.

Figure 9:
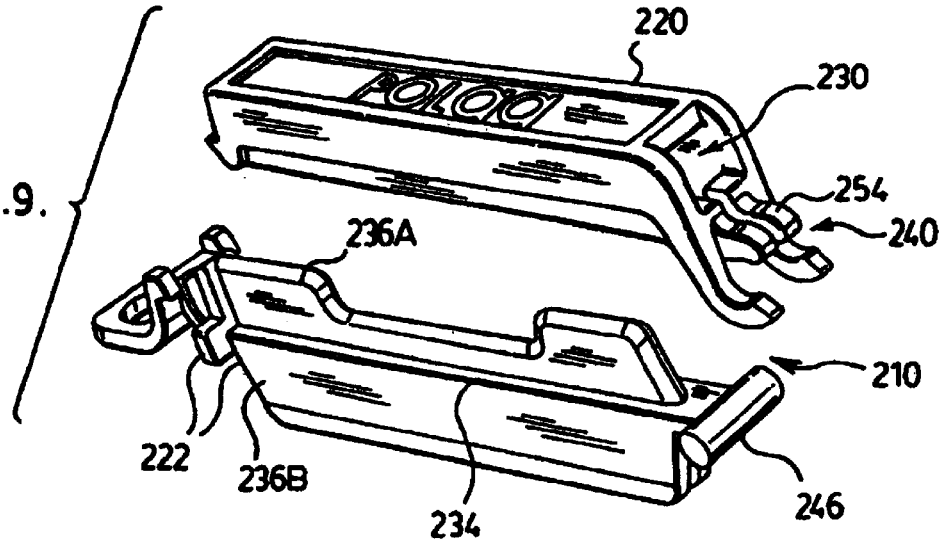
FIG. 9 shows a clip in accordance with a third embodiment in perspective, exploded view from the rear, left side.
Figure 10:
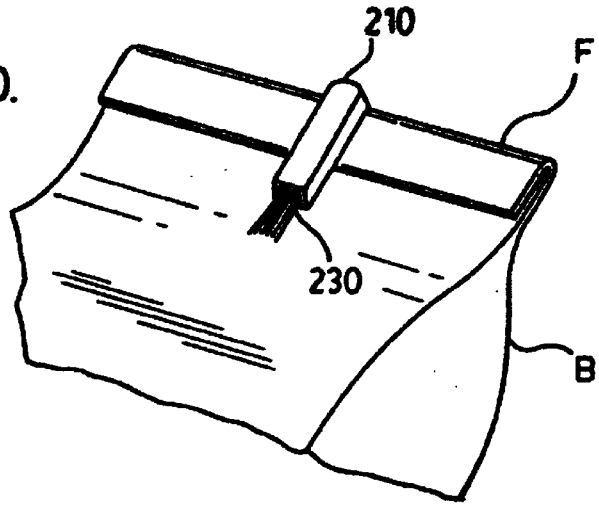
FIG. 10 shows the clip of FIG. 9 in one manner of use.

Referring now to FIGS. 9 & 10, a third embodiment of a clip in accordance with the invention is identified therein by the numeral 210. Clip 210 includes an upper jaw 220 which is similar to that of the first embodiment, and a lower jaw 222. The lowerjaw comprises an axially extending flange having first and second ribs 236A, 236B depending therefrom in back to back relationship. Rib 236A as illustrated, is shown in confronting relationship with the upper jaw 222, and may be used to close the neck of a plastic bag or other deformable container in the manner more particularly described in the foregoing –572 patent, i.e. wherein the clip is latched closed about the gathered neck of the bag.

Clip 210 is specifically adapted for use with oven roasting bags, which are themselves well known in commerce. The instructions issued with the bags include the steps of tying the bag closed, and puncturing the walls of the bag several times with the tines of a fork. This last step is necessary to permit the escape of vapors from the bag during the cooking process. Such puncturing of the bag is rather imprecise, and leads to unpredictable results; moreover, since it destroys the integrity of the bag, this cannot be used for the subsequent storage of food and is probably unsuited for any further purpose.

Clip 210 is used in a roasting process in the manner shown in FIG. 10. Here, the top of a bag B is folded over in a fold F across the whole of its width, and clip 210 is applied in a transverse manner to the fold. The arrangement functions as a simple valve to permit gases to escape from bag B in a controlled manner, without destroying the integrity of the bag, so as to permit its subsequent use for storage purposes if desired. When clip 210 is used for roasting in this manner, it will be appreciated that it will not be possible to latch the jaws closed if the integrity of the bag B is to be retained, and lower jaw 222 is devoid of any latch element associated with rib 236B. When clip 210 is used to close a roasting bag in the manner suggested by FIG. 10 the clip is assembled by the user with rib 236B in confronting relationship to upper jaw 220. Rib 236B is sized to provide a light interference with the inwardly facing surfaces of the side walls 226 of the upper jaw, so as to retain the jaws of the clip closed without their being latched. When clip 210 is closed about a bag B in the manner illustrated, a strong interference will result; this is particularly so as the material from which clip 210 is manufactured will normally be fiber reinforced, and will have a high modulus of elasticity, so as to be capable of withstanding oven roasting temperatures, typically in the range of about 180 to 205° C. (350 to 400° F.), and the walls of the clip will tend not to deform. In order to accommodate the use of bags of different wall thickness, the side walls 226 of the clip are not connected at the forward end of the jaw by any end wall, whereby the channel 230 of jaw 220 is open ended at this end. This permits the side walls 226 to splay apart under the influence of a heavy load, and also promotes the gripping action of the clip when used for roasting in the foregoing manner. Still further, as may be appreciated from FIG. 10, the open forward end of channel 230 facilitates the relatively smooth entry of the walls of bag B into the channel. It will be remarked that in the hinge 240 of this embodiment, the tongue portion 254 is furcated axially, whereby the side walls 226 at the rearward end of clip 210 are not bridged across, so as not to constrain any desired splaying movement.

What is claimed is:

1. A molded clip comprising an upper jaw and a lower jaw generally coextensive therewith, each said jaw having a forward end and a rearward end axially opposed thereto; hinge means interconnecting said rearward ends to permit said jaws to rotate between a closed position in which said jaws are in mutually confronting relationship and an open position; a cooperating latch element disposed at said forward end of each of said jaws for releasably latching said jaws in said closed position; characterized wherein said hinge means comprises a hinge bearing disposed at the rearward end of said jaws, said hinge bearing comprising a pair of laterally spaced apart, rearwardly extending lower bearing portions to define a passage therebetween, and at least one rearwardly extending upper bearing portion disposed in superior, spaced apart relation to said lower portions; mutually confronting surfaces of said portions together defining a transversely extending gudgeon opening and a rearwardly open throat of restricted diameter in comparison to that of said gudgeon opening communicating with said passage and said gudgeon opening; said hinge means further comprising a tab extending rearwardly from the rearward end of the lower of said jaws and a hinge element receivable in said gudgeon opening for rotation therein, said hinge element and said throat being dimensioned to permit the passage of the hinge element therethrough under the influence of a biasing force.

2. A molded clip as defined in claim 1 wherein said pair of lower bearing portions projects rearwardly beyond said at least one upper bearing portion to form an abutment stop limiting the travel of said lower jaw towards an open position.

3. A molded clip as defined in claim 2 wherein said lower bearing portions are connected at their distal ends by a bight.

4. A molded clip as defined in claim 1 wherein said upper jaw has a channel opening closed at said rearward end by a rear wall from which said hinge bearing is mounted, and where a portal is provided in said rear wall communicating with said passage and extending upwardly to adjacent said at least one upper portion, but not therebeyond.

5. A molded clip as defined in claim 1 wherein said jaws are provided adjacent their rearward ends with cooperating shoulder means independent of said hinge bearing to restrict relative axial movement of said jaws under reactive forces created by the closure of said jaws about an object.

6. A molded clip as defined in claim 3 further comprising a clip accessory detachably mounted on said bight.

7. A molded clip as defined in claim 6 wherein said accessory is rotatably mounted on said bight so as to be movable between a first position wherein it overlays a portion of said clip and a second position wherein it extends generally axially therefrom.

8. A molded clip as defined in claim 7 wherein said accessory is a scoop.

9. A molded clip as defined in claim 1 wherein said top wall is provided with a pair of axially spaced apart slots, and further comprising a handle detachably mounted in said slots to arch therebetween.

10. A molded clip as defined in claim 1 wherein said upper jaw has a channel opening therealong open at the axial end thereof at which said latch elements are disposed.

11. A molded clip as defined in claim 10 wherein the lower jaw of said clip has a pair of ribs in back to back disposition, and said hinge permits said lower jaw to be oriented whereby either of said ribs may be positioned in confronting relation with said upper jaw.

12. A molded clip as defined in claim 11 wherein one only of said ribs has a cooperating latch element associated therewith.

13. A molded clip as defined in claim 11 wherein upper bearing portion is axially forcated.

14. A molded clip as defined in claim 1 further comprising a finger rigidly joined to one of said jaws at a root to define with said jaw an elongated slot of diminishing width on approach to the root, and wherein a cutting blade is mounted within said slot.

15. A molded clip as defined in claim 1 further comprising a finger resiliently mounted to one of said jaws to form a hook for retaining said clip on a container.

* * * * *